US006899023B2

(12) United States Patent
Brendel et al.

(10) Patent No.: US 6,899,023 B2
(45) Date of Patent: May 31, 2005

(54) EXTENDED-NIP ROLL PRESS FOR DEWATERING A FIBROUS WEB

(75) Inventors: Bernhard Brendel, Grefrath (DE); Peter Hader, Kempen (DE)

(73) Assignee: Eduard Küsters Maschinenfabrik GmbH & Co. KG, Krefeld (DE)

( * ) Notice: Subject to any disclaimer, the term of this patent is extended or adjusted under 35 U.S.C. 154(b) by 0 days.

(21) Appl. No.: 10/192,977

(22) Filed: Jul. 10, 2002

(65) Prior Publication Data

US 2003/0024405 A1 Feb. 6, 2003

(30) Foreign Application Priority Data

Jul. 11, 2001 (DE) ..... 101 33 531

(51) Int. Cl.[7] ..... D21F 3/06; B30B 3/00

(52) U.S. Cl. ..... 100/327; 100/156; 100/164; 100/168; 162/358.3

(58) Field of Search ..... 100/327, 155 R, 100/156, 162 R, 168, 172, 176, 159, 160, 163 R, 164, 163 A, 169, 170; 162/205, 358.3, 358.4, 361, 202, 203, 358.1

(56) References Cited

U.S. PATENT DOCUMENTS 5,134,010 A * 7/1992 Schiel ..... 428/113
5,925,219 A * 7/1999 Schiel ..... 162/205
6,036,820 A * 3/2000 Schiel et al. ..... 162/358.3

FOREIGN PATENT DOCUMENTS

| | | | |
|---|---|---|---|
| DE | 2759035 | | 10/1979 |
| DE | 3503240 | C2 | 11/1987 |
| DE | 3708189 | C2 | 1/1989 |
| JP | 2000119985 | * | 4/2000 |

* cited by examiner

*Primary Examiner*—Allen Ostrager
*Assistant Examiner*—Shelley Self
(74) *Attorney, Agent, or Firm*—Townsend and Townsend and Crew LLP

(57) ABSTRACT

The invention relates to an extended-nip roll press for dewatering a fibrous web in a press nip which, on one side, is formed by a rotating mating roll and, on the other side, is formed by an extended-nip press roll, whose roll centers lie in a stack plane, and the extended-nip press roll has a stationary support and a flexible roll cover that can rotate about the support, the cover in the region of the press nip being supported on the support on a sliding surface which is formed on an upper part, defining an entry and exit, of a press shoe that can be displaced with respect to the support in a loading direction, it being possible for the press shoe to be displaced radially along a loading plane which intersects the stack plane at the center of the mating roll and at an acute angle to the exit direction.

7 Claims, 3 Drawing Sheets

EXTENDED-NIP ROLL PRESS FOR DEWATERING A FIBROUS WEB

CROSS-REFERENCES TO RELATED APPLICATIONS

This application claims priority from German application no. 101 22 531.8 filed on Jul. 11, 2001, under 35 USC §119, the full disclosure of which is incorporated herein by reference.

BACKGROUND OF THE INVENTION

The invention relates to an extended-nip roll press for dewatering a fibrous web.

BRIEF SUMMARY OF THE INVENTION

An extended-nip roll press of this type is known, for example, from DE 35 03 240 C2, which has a driven opposing roll which is associated with a stationary supporting element having a press shoe guided therein. The press shoe can be pressed in the direction of the opposing roll by means of pressurized oil. An endless press cover is led around the supporting element. The press shoe forms, with the corresponding section of the cover of the opposing roll, an extended press nip, through which the fibrous web to be dewatered is led together with the press cover in the web running direction. For this purpose, the press shoe has an upper part which has a sliding track along which the press cover runs. The sliding track is matched to the outer surface of the opposing roll via the press nip width, depending on the desired pressing pressure profile. With regard to the pressing pressure profile, beginning at the entry to the press nip, an initially gradual rise in the pressing pressure up to a maximum and a sudden fall in the pressing pressure shortly before the exit from the press nip are desired, in order to counteract rewetting of the fibrous web at the exit from the press nip. For this purpose, the center of the sliding surface of the press shoe is set back slightly counter to the web running direction beside the pressing plane, so that an asymmetric pressing pressure distribution in a web running direction is achieved. However, the dryness contents of the fibrous web achieved were not satisfactory.

DE 37 08 189 C2 discloses an extended-nip roll press in which the mid-axes of the supporting element and of the opposing roll lie in a preferably vertical pressing plane, so that the press shoe arranged on the supporting element can be displaced laterally parallel to the pressing plane. However, the running path of the roll cover is arranged to be offset out of the pressing plane counter to the running direction of the fibrous web and is therefore eccentric in relation to the mid-axis of the supporting element, in order to reduce the risk of rewetting further. The disadvantage in this case, however, is that the roll centers no longer lie in the stack plane, which increases the stress and the wear on the rotating components, in particular the flexible roll cover.

SUMMARY AND OBJECTS OF THE INVENTION

It is therefore an object of the invention to provide an extended-nip roll press of the type mentioned which is constructed simply and with which high dryness content values in the fibrous web can be achieved.

This provides an extended-nip roll press which, by means of setting the press shoe obliquely with respect to the stack plane, is constructed symmetrically with only one stack plane, but shortly before the exit from the press nip, a sudden drop in the pressing pressure is achieved, so that rewetting of the fibrous web at the exit from the press nip is largely prevented. In particular, a steeper pressure variation during dewatering is achieved, although the press shoe is located symmetrically with respect to the loading plane. In addition, the stress on the roll cover is reduced and the wear on the same is reduced, since in particular the axis of rotation of the roll cover can coincide with the rotational centers of the roll cover mountings on both sides.

The press shoe can be tilted with respect to the support or the press shoe together with the support can be tilted, for which purpose the support can be rotated about the roll center of the press roll.

The acute angle between stack and loading plane can be selected as desired on the basis of a desired rise in the pressure variation in the press nip, and preferably lies in the range from 1° to 5°.

In addition, as compared with a mid-axis of the press shoe, the upper part of the press shoe can be longer in the entry direction than in the exit direction, in order to achieve an optimum pressure curve in the press nip.

The press shoe can be equipped with hydraulic loading cylinders, which permit articulated compensation of the movement of the press shoe with respect to the support, in particular in order to compensate for thermal expansion.

Further refinements of the invention can be gathered from the claims and the following description.

The invention will be explained in more detail below using the exemplary embodiments illustrated in the appended figures.

DETAILED DESCRIPTION OF THE INVENTION

Figure 1:
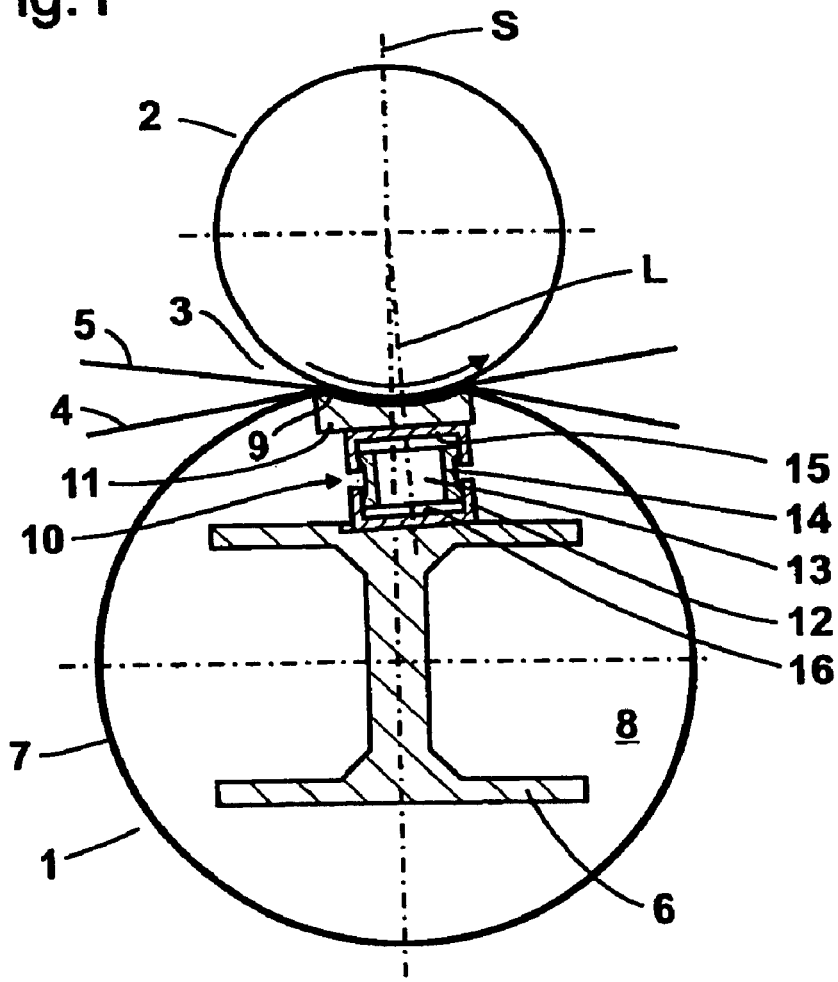
FIG. 1 shows, in a schematic cross section, an mating roll and an extended-nip press roll belonging to an extended-nip roll press according to a first exemplary embodiment.

FIG. 1 shows an extended-nip roll press for dewatering a fibrous web, in particular a paper web, which can be part of a papermaking machine.

The extended-nip roll press comprises an extended-nip press roll 1 and a driven mating roll 2, which interact in a press nip 3. The extended-nip press roll 1 and the mating roll 2 define a stack plane S with their roll centers. Here, the stack plane S runs vertically. Alternatively, the extended-nip press roll 1 and the mating roll 2 can also be arranged in such a way that the stack plane S runs at an angle or horizontally. At least one felt web 4 and the fibrous web 5 to be pressed are led through the press nip 3.

The extended-nip press roll 1 comprises a stationary support 6 and a roll cover 7 which can rotate about the support 6 and made of a flexible material, for example rubber or plastic. The roll cover 7 is tube-like and, at its ends, is fixed to the cover (not illustrated) which is seated such that it can rotate on the support 6, in order to form a closed extended-nip press roll 1. An interspace 8 between support 6 and roll cover 7 can be supplied with compressed air, as a result of which the roll cover 7 can be inflated in order to obtain a cylindrical shape. Because of the transport of the roll cover, this cylindrical shape is required for the start of operation of the extended-nip press roll 1. During operation, the cylindrical shape prevents the roll cover fluttering. The axis of rotation of the roll cover in this case coincides with the rotational centers of the roll cover mountings on both sides.

Provided on the support 6 is a press shoe 10, which has an upper part 11 on which a sliding surface 9 is formed, on which the roll cover 7 is supported in the area of the press nip 3. The sliding surface 9 is preferably convex at the edges in cross section and, in the supporting area, is predominantly concave. The press shoe 10 can be pressed in the direction of the mating roll 2 by means of pressurized oil. The press shoe 10, with the corresponding section of the cover of the mating roll 2, forms the extended press nip 3, through which the at least one felt web 4 and the fibrous web to be dewatered are guided in the web running direction together with the roll cover 7. In this case, the non-driven roll cover 7 is carried along by the webs 5, 4, the sliding surface 9 defining an entry and an exit. The exit direction is indicated in FIG. 1 by the arrow in the driven mating roll 2. The press nip 3 is lubricated hydrodynamically and/or hydrostatically in a known manner.

The press shoe 10 comprises a supporting bar, to which the upper part 11 which carries the sliding surface 9 is fixed. The supporting bar comprises a plurality of supporting arrangements 12 which are arranged at a distance from one another, contain piston-like parts and in each case are supported on the support 6. The supporting arrangements 12 can be moved in the direction of the mating roll 2, on account of pressure being applied to a pressure chamber 13, which is connected to a hydraulic pressure means, for example oil or water. The pressure-medium lines are connected in a known way.

The press shoe 10 then defines a loading plane L, which is formed by the geometric center line of the supporting arrangements 12. The arrangement of the press shoe 10 with respect to the stack plane S is such that the loading plane L of the press shoe 10 intersects the stack plane S at the center of the mating roll 2 and at an acute angle to the exit direction, and the press shoe 10 can be displaced radially along this loading plane L aligned in this way in relation to the stack plane S. The arrangement of the press shoe 10 can be made in such a way that the loading plane L is rotated with respect to the stack plane S at an angle in the range from 1° to 5°.

In order to align the press shoe 10 with respect to the stack plane S, the press shoe 10 is arranged to be tilted on the support 6, according to FIG. 1. The upper part 11 is preferably formed in such a way that, as compared with the loading plane L, the said upper part is longer in the entry direction than in the exit direction.

Forming the supporting arrangements 12 as hydraulic loading cylinders can be carried out as described in DE-B 27 59 035, for example. Because of the different thermal expansion between the supporting bar and the support 6 and length differences arising because of deflection of the support 6, it is preferable to use fixed tubular piston parts 14 which, at their two ends, are guided in a sealing and articulated manner in recesses in an upper part connection 15 and a support connection 16, which form cylinder sections in each case. The tubular piston parts 14 permit the upper part 11 to be inclined with respect to the support 6.

Figure 2:
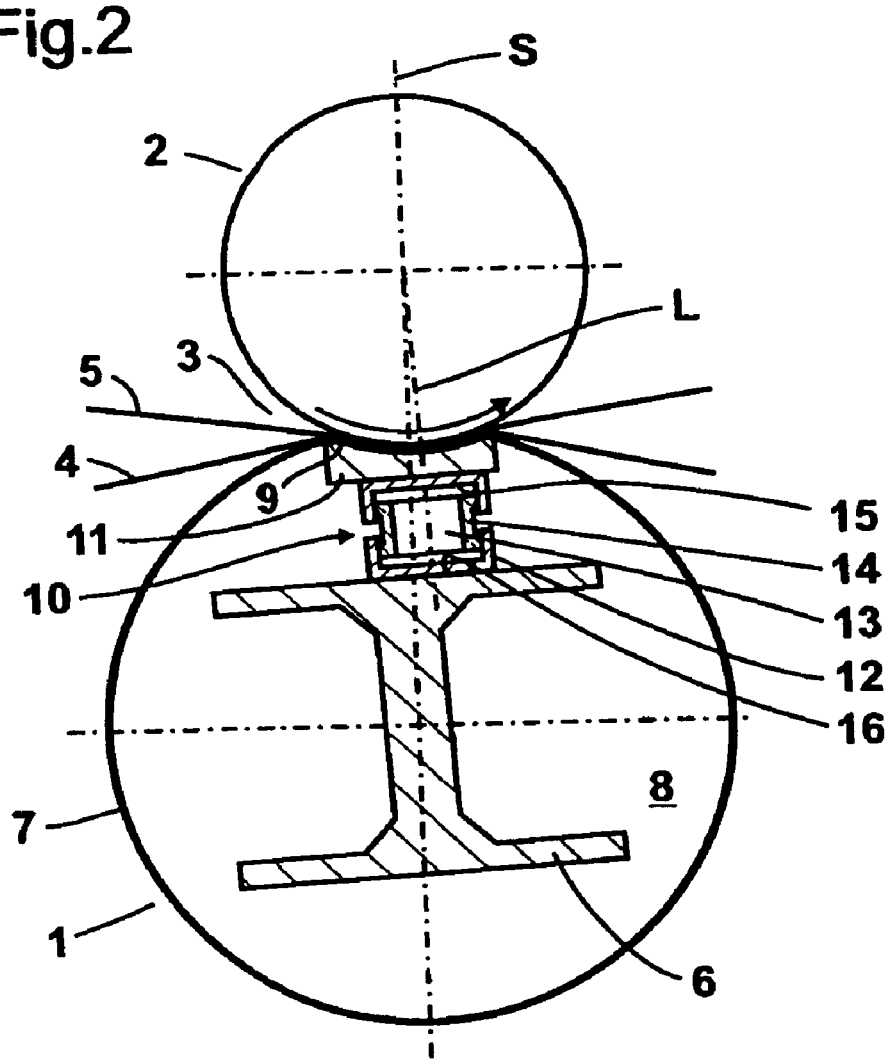
FIG. 2 shows, in a schematic cross section, an mating roll and an extended-nip press roll belonging to an extended-nip roll press according to a second exemplary embodiment.

The second exemplary embodiment, illustrated in FIG. 2, differs from the exemplary embodiment illustrated in FIG. 1 in that the support 6 is tilted together with the press shoe 10, so that the press shoe 10 can be displaced radially along a loading plane L that intersects the stack plane S at the center of the mating roll 2 and at an acute angle to the exit direction. For this purpose, the support 10 is preferably rotated about the center of the extended-nip press roll in a framework (not illustrated). The press shoe 10 is then arranged on the support 6, aligned parallel with the latter. Otherwise, the above explanations relating to FIG. 1 apply appropriately.

Figure 3:
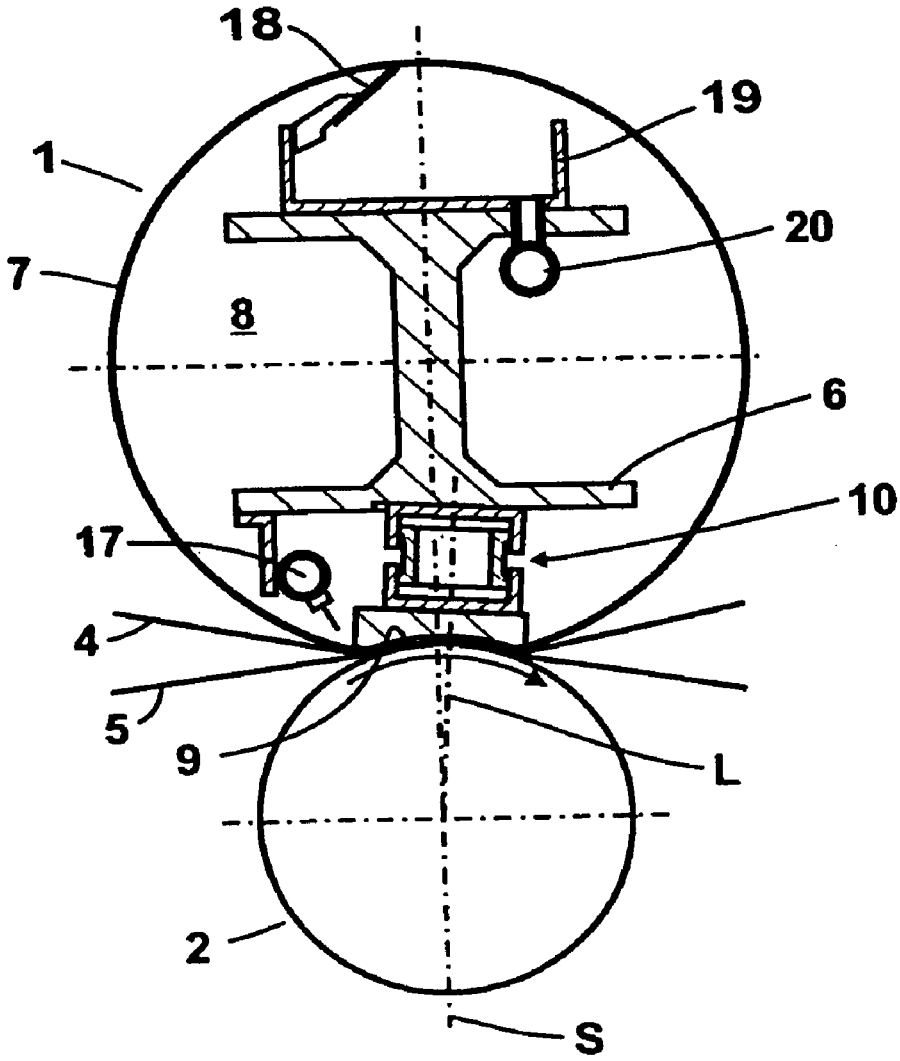
FIG. 3 shows, in a schematic cross section, an mating roll and an extended-nip press roll belonging to an extended-nip roll press according to a third exemplary embodiment.

FIG. 3 shows a third exemplary embodiment, which differs from the first exemplary embodiment illustrated in FIG. 1 in that the extended-nip press roll 1 is arranged on the top side of the mating roll 2, which results in a press shoe 10 located at the top. Otherwise, the explanations relating to FIG. 1 apply appropriately. In addition, FIG. 3 shows that, for hydrodynamic lubrication of the press nip 3, an oil feed 17 is provided at the entry to the press nip 3. By means of a scraper 18, the lubricant applied to the inner side of the roll cover 7 can be doctored off again downstream of the press nip 3. The scraper 18 is preferably arranged in an upper region of the extended-nip press roll 1, in order to use the force of gravity to cause the lubricant doctored off to flow into a collecting container 19, from where it can be discharged via at least one line 20.

All publications and patent applications mentioned in this specification are herein incorporated by reference to the same extent as if each individual publication or patent application was specifically and individually indicated to be incorporated by reference.

The invention now being fully described, it will be apparent to one of ordinary skill in the art that many changes and modifications can be made thereto without departing from the spirit or scope of the appended claims.

What is claimed is:

1. An extended-nip roll press for dewatering a material web in a press nip, the extended-nip roll press comprising:

a rotating mating roll;

an extended-nip press roll, the mating roll and the extended-nip press roll having parallel roll centers that lie in a stack plane and being located circumferentially adjacent to each other such that the press nip is formed therebetween;

a stationary support;

a flexible, tubular roll cover positioned so that the roll cover can rotate about the stationary support to define the extended nip press roll; and a press shoe mounted on the stationary support and having an upper surface slidable supporting the roll cover at the press nip, and an internal hydraulic cylinder that displaces the entire press shoe with respect to the support in a loading direction, such that the press shoe can be displaced radially about the roll center of the mating roll to form a loading plane which intersects the stack plane at the center of the mating roll and at an acute angle to the stack plane to displace the point of applied force in the press nip.

2. Extended-nip roll press according to claim 1, wherein the press shoe is arranged to be tilted on the support.

3. Extended-nip roll press according to claim 2, wherein the support is arranged to be tilted together with the press shoe.

4. Extended-nip roll press according to one of claims 1 to 3, wherein the loading plane is rotated with respect to the stack plane at an acute angle in the range 1° to 5°.

5. An extended-nip roll press according to one of claims 1 to 3, wherein the upper part surface of the press shoe, as compared with a mid-axis of the press shoe, is longer in the entry direction than in the exit direction.

6. An extended-nip roll press according to one of claims 1 to 3, wherein the press shoe comprises a plurality of articulated hydraulic loading cylinders, which are arranged at a distance from one another in the transverse direction, each hydraulic loading cylinder in each case comprising a tubular cylindrical piston element, which, at its end, on one side engages in an articulated manner in a section of a cylinder on the upper part and, on the other side, engages in an articulated manner in a section of a cylinder on the support, each piston element positioned between opposing cylindrical support connections such that the upper surface can be inclined with respect to the support.

7. An extended-nip roll press according to one of claims 1 to 3, wherein the extended-nip press roll and the mating roll are arranged in a vertical stack plane, and the extended-nip press roll is constructed above the mating roll with a press shoe located at the top of the nip press.

* * * * *